US012589907B2

(12) United States Patent
Kearns et al.

(10) Patent No.: US 12,589,907 B2
(45) Date of Patent: Mar. 31, 2026

(54) TRAY FOR FOOD PRODUCTS

(71) Applicant: Graphic Packaging International, LLC, Atlanta, GA (US)

(72) Inventors: Matthew R. Kearns, Woodstock, GA (US); Thomas Brink, Grand Rapids, MI (US); Scott Thomas Strand, Lake Elmo, MN (US); Elliot Hithersay, Derby (GB)

(73) Assignee: Graphic Packaging International, LLC, Atlanta, GA (US)

( * ) Notice: Subject to any disclaimer, the term of this patent is extended or adjusted under 35 U.S.C. 154(b) by 107 days.

(21) Appl. No.: 17/519,092

(22) Filed: Nov. 4, 2021

(65) Prior Publication Data

US 2022/0144475 A1 May 12, 2022

Related U.S. Application Data

(60) Provisional application No. 63/191,412, filed on May 21, 2021, provisional application No. 63/178,116,
(Continued)

(51) Int. Cl.
*B65D 5/42* (2006.01)
*B65D 5/20* (2006.01)
(Continued)

(52) U.S. Cl.
CPC ..... *B65D 5/4295* (2013.01); *B65D 5/2047* (2013.01); *B65D 5/248* (2013.01);
(Continued)

(58) Field of Classification Search
CPC ..... B65D 5/2047; B65D 5/2038; B65D 5/20; B65D 5/42
(Continued)

(56) References Cited

U.S. PATENT DOCUMENTS 622,921 A 4/1899 Fuller
667,634 A 2/1901 Schmidt
(Continued)

FOREIGN PATENT DOCUMENTS

AU 2018 204 778 A1 1/2019
DE 1810600 A1 * 7/1969 ..... B65D 5/243
(Continued)

OTHER PUBLICATIONS

International Search Report and Written Opinion for PCT/US2021/058043 dated Feb. 18, 2022.
(Continued)

*Primary Examiner* — Ernesto A Grano
*Assistant Examiner* — Symren K Sanghera
(74) *Attorney, Agent, or Firm* — Andrew N. Claerbout; FisherBroyles, LLP

(57) ABSTRACT

A tray for holding at least one food product, the tray includes a plurality of panels extending at least partially around an interior of the tray, the plurality of panels including a bottom panel, a front panel, a back panel, and at least one side panel, a plurality of end flaps foldably connected to a respective panel of the plurality of panels and cooperating to form a rim extending outwardly from the plurality of panels, and reinforcement features for supporting the rim, the reinforcement features including at least one reinforcement tab extending from a respective panel of the plurality of panels and contacting a portion of a respective end flap of the plurality of end flaps.

5 Claims, 8 Drawing Sheets

Related U.S. Application Data filed on Apr. 22, 2021, provisional application No. 63/174,724, filed on Apr. 14, 2021, provisional application No. 63/169,302, filed on Apr. 1, 2021, provisional application No. 63/169,418, filed on Apr. 1, 2021, provisional application No. 63/139,341, filed on Jan. 20, 2021, provisional application No. 63/128,418, filed on Dec. 21, 2020, provisional application No. 63/126,157, filed on Dec. 16, 2020, provisional application No. 63/110,578, filed on Nov. 6, 2020, provisional application No. 63/110,587, filed on Nov. 6, 2020, provisional application No. 63/110,582, filed on Nov. 6, 2020.

(51) Int. Cl.

| | |
|---|---|
| ***B65D 5/24*** | (2006.01) |
| ***B65D 5/28*** | (2006.01) |
| ***B65D 5/44*** | (2006.01) |
| ***B65D 21/02*** | (2006.01) |
| ***B65D 85/50*** | (2006.01) |

(52) U.S. Cl.
CPC ..... *B65D 5/4266* (2013.01); *B65D 5/4279* (2013.01); *B65D 5/443* (2013.01); *B65D 21/0233* (2013.01); *B65D 85/50* (2013.01); *B65D 5/28* (2013.01)

(58) Field of Classification Search
USPC ..... 206/557
See application file for complete search history.

(56) References Cited

U.S. PATENT DOCUMENTS 1,683,761 A 9/1928 Craig
1,894,209 A 1/1933 Wikstrom
1,999,461 A 4/1935 Kells
2,016,754 A 10/1935 Perkit
2,028,276 A 1/1936 Evans
2,037,502 A 4/1936 Cox
2,043,104 A 6/1936 Clancy
2,163,017 A 6/1939 Berch
2,232,088 A 2/1941 Waters
2,279,670 A 4/1942 Ford et al.
2,321,848 A 6/1943 O'Reilly
2,740,576 A 4/1956 Franck
2,800,893 A 7/1957 Norman et al.
2,836,339 A 5/1958 Pringle
2,858,630 A 11/1958 Gorman
2,859,905 A 11/1958 Choate
2,944,721 A 7/1960 Choate
3,102,674 A 9/1963 Portola
3,116,866 A * 1/1964 Boran ..... B65D 5/241 229/122.34
3,246,830 A 4/1966 Smith
3,276,660 A 10/1966 Vesak
3,300,117 A 1/1967 Kossnar
3,316,102 A * 4/1967 Doll ..... B65D 5/2033 229/116
3,355,085 A 11/1967 Olaf
3,366,306 A 1/1968 Kotowick
3,425,543 A 2/1969 Harvey
3,447,672 A 6/1969 Bailey et al.
3,478,950 A 11/1969 Stevens
3,515,331 A 6/1970 Guthrie, Sr.
3,516,594 A 6/1970 Stenzel
3,516,595 A 6/1970 Bailey
3,536,248 A 10/1970 Eriksson
3,550,835 A 12/1970 Persson
3,559,869 A 2/1971 Reynolds
3,606,078 A 9/1971 Phillips, Jr.
3,630,430 A 12/1971 Struble
3,637,130 A 1/1972 Farquhar
3,701,467 A 10/1972 Johansson
3,715,853 A 2/1973 Bemiss
3,739,939 A 6/1973 Koenig
3,756,495 A 9/1973 Bemiss
3,767,108 A 10/1973 Arneson
3,833,113 A 9/1974 Osier
3,845,897 A 11/1974 Buttery et al.
3,863,832 A 2/1975 Gordon
3,876,131 A 4/1975 Tolaas
3,877,632 A 4/1975 Steel
3,912,331 A 10/1975 Turner et al.
3,917,155 A * 11/1975 Bemiss ..... B65D 5/243 229/160
3,927,823 A 12/1975 Persson
4,014,496 A 3/1977 Christensson
4,034,907 A 7/1977 Engdahl, Jr.
4,049,188 A 9/1977 Persson
4,054,241 A 10/1977 Meyers et al.
4,079,853 A 3/1978 Casutt
4,109,848 A 8/1978 Kipp et al.
4,114,797 A 9/1978 Manizza
4,124,160 A 11/1978 Meyers et al.
4,126,265 A 11/1978 Holmes
4,130,236 A 12/1978 Manizza
4,166,567 A 9/1979 Beach, Jr. et al.
4,185,764 A 1/1980 Cote
4,199,097 A 4/1980 Christensson
4,205,775 A 6/1980 Swan
4,227,640 A 10/1980 Roccaforte
4,244,472 A 1/1981 Brown
4,267,955 A 5/1981 Struble
4,277,506 A 7/1981 Austin
4,283,427 A 8/1981 Winters et al.
4,305,543 A 12/1981 Lai
4,308,985 A 1/1982 Manizza
4,362,266 A * 12/1982 Webinger ..... B65D 5/6658 229/110
4,410,129 A 10/1983 Wischusen, III
4,417,882 A 11/1983 Wallin
4,418,861 A 12/1983 McFarland et al.
4,432,489 A 2/1984 Cote
4,502,623 A 3/1985 Moore et al.
4,607,785 A 8/1986 Croley
4,648,549 A 3/1987 Trutna
4,676,429 A 6/1987 Crowe et al.
D290,813 S 7/1987 Forbes, Jr.
4,682,727 A 7/1987 Stoll
4,718,596 A * 1/1988 Muller ..... B65D 5/2033 229/109
4,765,534 A 8/1988 Zion et al.
4,775,771 A 10/1988 Pawlowski et al.
4,792,084 A 12/1988 Dreeszen
4,801,774 A 1/1989 Hart
4,836,439 A 6/1989 Hart
4,846,398 A 7/1989 Johnson
4,865,921 A 9/1989 Hollenberg et al.
4,871,111 A 10/1989 Mode
4,890,439 A 1/1990 Smart
4,901,911 A 2/1990 Drexhage
4,905,834 A 3/1990 Mur Gimeno et al.
4,915,235 A 4/1990 Roosa
4,919,267 A 4/1990 Stoll
4,936,935 A 6/1990 Beckett
4,943,456 A 7/1990 Pollart et al.
4,955,530 A 9/1990 Rigby
4,963,424 A 10/1990 Beckett
4,998,669 A * 3/1991 Karolyi ..... B65D 5/246 229/188
5,002,826 A 3/1991 Pollart et al.
5,039,364 A 8/1991 Beckett et al.
5,049,710 A 9/1991 Prosise et al.
5,077,455 A 12/1991 Peleg et al.
5,117,078 A 5/1992 Beckett
5,118,747 A 6/1992 Pollart et al.
5,211,330 A 5/1993 Frey
5,213,902 A 5/1993 Beckett
5,221,419 A 6/1993 Beckett
5,232,149 A 8/1993 Stoll
5,247,149 A 9/1993 Peleg

(56) References Cited

U.S. PATENT DOCUMENTS

| | | | |
|---|---|---|---|
| 5,260,537 | A | 11/1993 | Beckett |
| 5,266,386 | A | 11/1993 | Beckett |
| 5,294,765 | A | 3/1994 | Archibald et al. |
| 5,326,021 | A | 7/1994 | Farrell |
| RE34,683 | E | 8/1994 | Maynard et al. |
| 5,338,921 | A | 8/1994 | Maheux et al. |
| 5,340,436 | A | 8/1994 | Beckett |
| 5,351,879 | A | 10/1994 | Liu et al. |
| 5,354,973 | A | 10/1994 | Beckett |
| 5,410,135 | A | 4/1995 | Pollart et al. |
| 5,412,187 | A | 5/1995 | Walters et al. |
| 5,424,517 | A | 6/1995 | Habeger, Jr. et al. |
| 5,433,374 | A | 7/1995 | Forbes, Jr. |
| 5,519,195 | A | 5/1996 | Keefer et al. |
| 5,520,322 | A | 5/1996 | Conviser |
| 5,530,231 | A | 6/1996 | Walters et al. |
| 5,535,942 | A | 7/1996 | Vilona |
| 5,628,921 | A | 5/1997 | Beckett |
| 5,672,407 | A | 9/1997 | Beckett |
| 5,718,368 | A | 2/1998 | Rench et al. |
| 5,720,429 | A | 2/1998 | Cordle |
| 5,726,426 | A | 3/1998 | Davis et al. |
| 5,759,422 | A | 6/1998 | Schmelzer et al. |
| 5,762,225 | A | 6/1998 | Byrd |
| 5,800,724 | A | 9/1998 | Habeger et al. |
| 5,816,485 | A | 10/1998 | Bernstein |
| 5,948,308 | A | 9/1999 | Wischusen, III |
| 5,961,035 | A | 10/1999 | Correll |
| 6,019,276 | A | 2/2000 | Auclair |
| 6,050,482 | A | 4/2000 | Cai |
| 6,050,483 | A | 4/2000 | Haraldsson |
| 6,092,720 | A | 7/2000 | Karolyi |
| 6,102,281 | A | 8/2000 | Lafferty et al. |
| 6,114,679 | A | 9/2000 | Lai et al. |
| 6,137,099 | A | 10/2000 | Hamblin |
| 6,150,646 | A | 11/2000 | Lai et al. |
| 6,170,740 | B1 | 1/2001 | Clark |
| D437,557 | S | 2/2001 | Ingelin et al. |
| 6,182,890 | B1 | 2/2001 | Sattler et al. |
| 6,204,492 | B1 | 3/2001 | Zeng et al. |
| 6,251,451 | B1 | 6/2001 | Zeng |
| 6,273,610 | B1 | 8/2001 | Koyama |
| 6,359,272 | B1 | 3/2002 | Sadek et al. |
| 6,371,363 | B1 | 4/2002 | Franklin et al. |
| 6,371,364 | B1 | 4/2002 | Maillot |
| 6,393,761 | B1 | 5/2002 | Deacon |
| 6,414,290 | B1 | 7/2002 | Cole et al. |
| 6,433,322 | B2 | 8/2002 | Zeng et al. |
| 6,455,827 | B2 | 9/2002 | Zeng |
| 6,513,704 | B1 | 2/2003 | Perot |
| 6,552,315 | B2 | 4/2003 | Zeng et al. |
| 6,561,414 | B1 | 5/2003 | Cai |
| 6,588,652 | B2 | 7/2003 | Cai |
| 6,677,563 | B2 | 1/2004 | Lai |
| 6,717,121 | B2 | 4/2004 | Zeng et al. |
| 6,719,190 | B2 | 4/2004 | Yocum |
| 6,765,182 | B2 | 7/2004 | Cole et al. |
| 6,808,105 | B2 | 10/2004 | Lee |
| 7,007,838 | B1 | 3/2006 | Bostick, II |
| 7,017,797 | B2 | 3/2006 | Goglio |
| 7,019,271 | B2 | 3/2006 | Wnek et al. |
| 7,140,532 | B2 | 11/2006 | Holt et al. |
| 7,219,828 | B2 | 5/2007 | Lombardo |
| 7,232,055 | B1 | 6/2007 | Lim |
| 7,273,162 | B2 | 9/2007 | Baker |
| 7,323,669 | B2 | 1/2008 | Robison et al. |
| 7,328,833 | B1 | 2/2008 | Wiley |
| D563,155 | S | 3/2008 | Wyllie |
| D567,592 | S | 4/2008 | Fite, IV |
| 7,351,942 | B2 | 4/2008 | Wnek et al. |
| 7,365,292 | B2 | 4/2008 | Cole et al. |
| 7,473,875 | B2 | 1/2009 | Fitzwater |
| 7,514,659 | B2 | 4/2009 | Lafferty |
| 7,541,562 | B2 | 6/2009 | Cole et al. |
| D600,550 | S | 9/2009 | King |
| D603,255 | S | 11/2009 | King |
| D603,256 | S | 11/2009 | King |
| 7,648,031 | B2 | 1/2010 | Kari |
| 7,648,059 | B2 | 1/2010 | Pavlu, Jr. et al. |
| 7,667,167 | B2 | 2/2010 | Fitzwater |
| 7,743,971 | B2 | 6/2010 | DeVine |
| 7,748,536 | B2 | 7/2010 | Cassese et al. |
| 7,762,394 | B2 | 7/2010 | Bradford et al. |
| D622,589 | S | 8/2010 | Elias |
| 7,793,821 | B2 | 9/2010 | Oliveira |
| 7,798,327 | B1 | 9/2010 | Berkani et al. |
| 7,824,719 | B2 | 11/2010 | Cole et al. |
| 7,870,995 | B1 | 1/2011 | Kaltman |
| 7,893,389 | B2 | 2/2011 | Fitzwater |
| 7,959,061 | B2 | 6/2011 | Kaltman |
| 7,975,871 | B2 | 7/2011 | Wnek et al. |
| 7,982,167 | B2 | 7/2011 | Fitzwater |
| 7,982,349 | B2 | 7/2011 | Popov et al. |
| 8,013,280 | B2 | 9/2011 | Robison et al. |
| 8,063,344 | B2 | 11/2011 | Cole et al. |
| D650,667 | S | 12/2011 | Osentoski |
| 8,087,570 | B2 | 1/2012 | Ho Fung |
| 8,106,339 | B2 | 1/2012 | Robbins et al. |
| 8,158,914 | B2 | 4/2012 | Wnek et al. |
| 8,183,506 | B2 | 5/2012 | Fitzwater |
| 8,186,570 | B2 | 5/2012 | Learn |
| 8,252,217 | B2 | 8/2012 | Wnek et al. |
| 8,309,896 | B2 | 11/2012 | Fitzwater |
| D677,154 | S | 3/2013 | Miller |
| 8,492,690 | B1 | 7/2013 | Watkins |
| 8,534,536 | B2 | 9/2013 | Mueller et al. |
| 8,567,661 | B2 | 10/2013 | Sullivan |
| D699,447 | S | 2/2014 | Pirayesh |
| D719,019 | S | 12/2014 | Avis |
| 9,027,825 | B2 | 5/2015 | Baker |
| 9,078,296 | B2 | 7/2015 | Fitzwater |
| 9,113,648 | B2 | 8/2015 | Burke |
| 9,402,491 | B1 | 8/2016 | Debernardi |
| D775,947 | S | 1/2017 | Epstein |
| 9,676,511 | B2 | 6/2017 | Kaltman |
| 10,232,973 | B2 | 3/2019 | Burke |
| 10,336,500 | B2 | 7/2019 | Burke |
| D931,725 | S | 9/2021 | Rana |
| D942,267 | S | 2/2022 | Rana |
| 11,247,799 | B2 | 2/2022 | Arnold |
| 11,345,508 | B2 | 5/2022 | Wisecarver |
| 11,358,779 | B2 | 6/2022 | Tye |
| 11,370,576 | B1 | 6/2022 | Bevier |
| 11,434,038 | B2 | 9/2022 | Tye |
| 11,794,943 | B2 | 10/2023 | Sanchez |
| 2001/0032843 | A1 | 10/2001 | Aronsson et al. |
| 2002/0084319 | A1 | 7/2002 | Yocum |
| 2003/0006273 | A1 | 1/2003 | Tsern et al. |
| 2003/0102363 | A1 | 6/2003 | Chang |
| 2003/0197053 | A1 | 10/2003 | Haraldsson |
| 2003/0226881 | A1 | 12/2003 | Liou |
| 2004/0232034 | A1 | 11/2004 | Lebras |
| 2004/0234653 | A1 | 11/2004 | Cogley et al. |
| 2004/0238534 | A1 | 12/2004 | Mast |
| 2005/0082355 | A1 | 4/2005 | Beutler |
| 2005/0184066 | A1 | 8/2005 | Brooks et al. |
| 2005/0194286 | A1 | 9/2005 | Ilyayeva et al. |
| 2005/0205565 | A1 | 9/2005 | Cole et al. |
| 2006/0006215 | A1 | 1/2006 | Chen |
| 2006/0049190 | A1 | 3/2006 | Middleton et al. |
| 2006/0096978 | A1 | 5/2006 | Lafferty et al. |
| 2006/0113300 | A1 | 6/2006 | Wnek et al. |
| 2006/0180644 | A1 | 8/2006 | Baker |
| 2006/0278521 | A1 | 12/2006 | Stowell |
| 2007/0056962 | A1 | 3/2007 | Hopkins, Sr. et al. |
| 2007/0102424 | A1 | 5/2007 | Keefe |
| 2007/0131744 | A1 | 6/2007 | Fitzwater |
| 2007/0131745 | A1 | 6/2007 | Fitzwater |
| 2007/0215611 | A1 | 9/2007 | O'Hagan et al. |
| 2007/0251942 | A1 | 11/2007 | Cole et al. |
| 2007/0251943 | A1 | 11/2007 | Wnek et al. |
| 2007/0262487 | A1 | 11/2007 | O'Hagan et al. |
| 2007/0275130 | A1 | 11/2007 | Cole et al. |
| 2008/0000897 | A1 | 1/2008 | Robbins et al. |

(56) References Cited

U.S. PATENT DOCUMENTS

| | | | | |
|---|---|---|---|---|
| 2008/0023469 | A1 | 1/2008 | Fitzwater | |
| 2008/0035634 | A1 | 2/2008 | Zeng et al. | |
| 2008/0047958 | A1 | 2/2008 | Cole et al. | |
| 2008/0078759 | A1 | 4/2008 | Wnek et al. | |
| 2008/0081095 | A1 | 4/2008 | Cole et al. | |
| 2008/0110966 | A1 | 5/2008 | Yocum | |
| 2009/0072015 | A1 | 3/2009 | Drew et al. | |
| 2009/0090708 | A1 | 4/2009 | Requena et al. | |
| 2009/0218338 | A1 | 9/2009 | Futzwater | |
| 2010/0025393 | A1 | 2/2010 | Talpaert | |
| 2010/0038359 | A1 | 2/2010 | Laubhan et al. | |
| 2010/0051675 | A1 | 3/2010 | Sweet | |
| 2010/0065556 | A1 | 3/2010 | Cole | |
| 2010/0065621 | A1 | 3/2010 | Quaintance | |
| 2010/0072197 | A1 | 3/2010 | Neff et al. | |
| 2010/0102111 | A1 | 4/2010 | Learn | |
| 2010/0122999 | A1 | 5/2010 | Brand | |
| 2010/0193509 | A1 | 8/2010 | Fitzwater | |
| 2010/0264135 | A1 | 10/2010 | Cole | |
| 2011/0024413 | A1 | 2/2011 | Cole | |
| 2011/0089227 | A1 | 4/2011 | Kaltman et al. | |
| 2011/0114715 | A1 | 5/2011 | House | |
| 2011/0132903 | A1 | 6/2011 | Cole | |
| 2011/0233266 | A1 | 9/2011 | Pezzoli | |
| 2012/0228370 | A1 | 9/2012 | Faulon et al. | |
| 2013/0087607 | A1 | 4/2013 | Learn | |
| 2013/0299566 | A1 | 11/2013 | Sylvester | |
| 2014/0374953 | A1 | 12/2014 | Middleton | |
| 2015/0375468 | A1 | 12/2015 | Wnek | |
| 2016/0096648 | A1 * | 4/2016 | Pinkstone | B65B 11/004 426/115 |
| 2016/0360912 | A1 | 12/2016 | Chang | |
| 2021/0053714 | A1 | 2/2021 | Zwaga | |
| 2022/0048672 | A1 | 2/2022 | Bevier | |

FOREIGN PATENT DOCUMENTS

| | | | | |
|---|---|---|---|---|
| EP | 0 270 838 | | 6/1988 | |
| EP | 0 270 551 | B1 | 7/1990 | |
| EP | 0 392 227 | B1 | 2/1993 | |
| EP | 1 481 922 | | 12/2004 | |
| EP | 1 364 558 | | 3/2005 | |
| EP | 2 240 385 | | 6/2008 | |
| EP | 2 605 974 | | 3/2014 | |
| EP | 2 974 973 | | 1/2016 | |
| FR | 2 867 346 | | 9/2005 | |
| GB | 2 042 474 | A | 9/1980 | |
| GB | 2 137 170 | A | 10/1984 | |
| GB | 2234958 | A * | 2/1991 | B65D 5/246 |
| GB | 2 479 703 | A | 10/2011 | |
| JP | 53-161938 | U | 12/1978 | |
| JP | 4-253670 | | 9/1992 | |
| JP | 6-293334 | | 10/1994 | |
| JP | 7-040968 | | 2/1995 | |
| JP | 2000-255546 | A | 9/2000 | |
| JP | 2001-247122 | | 2/2001 | |
| JP | 2001-080628 | A | 3/2001 | |
| JP | 2011-006071 | | 1/2011 | |
| JP | 2018-047939 | A | 3/2018 | |
| KR | 20-0184133 | Y1 | 6/2000 | |
| KR | 10-1363935 | | 2/2014 | |
| KR | 10-1494078 | B1 | 2/2015 | |
| KR | 10-2019-0053053 | A | 5/2019 | |
| WO | WO 94/05563 | | 3/1994 | |
| WO | WO 02/060223 | | 8/2002 | |
| WO | WO 03/066435 | | 8/2003 | |
| WO | WO 2005/077783 | | 8/2005 | |
| WO | WO 2006/076501 | | 7/2006 | |
| WO | WO 2007/127235 | | 11/2007 | |
| WO | WO 2007/127371 | | 11/2007 | |
| WO | WO 2007/133659 | | 11/2007 | |
| WO | WO 2007/136839 | | 11/2007 | |
| WO | WO 2009/006096 | | 1/2009 | |
| WO | WO 2012/024206 | | 2/2012 | |
| WO | WO 2019/092323 | A1 | 5/2019 | |
| WO | WO 2019/179930 | A1 | 9/2019 | |

OTHER PUBLICATIONS

International Search Report and Written Opinion for PCT/US2021/058048 dated Feb. 18, 2022.
International Search Report and Written Opinion for PCT/US2021/058050 dated Feb. 22, 2022.
International Search Report and Written Opinion for PCT/US2021/058051 dated Feb. 17, 2022.
International Search Report and Written Opinion for PCT/US2021/058049 dated Feb. 22, 2022.
Frozen Food Europe: Announced [Jun. 29, 2021; online]. Retrieved [Nov. 2, 2023]. URL: https://www.frozenfoodeurope.com/ graphic-packaging-presents-new-dual-ovenable-cook-tray/ (Year: 2021).
PR Newswire: Announced [Apr. 20, 2021; online]. Retrieved [Nov. 2, 2023]. URL: https://www.prnewswire.com/news-releases/ graphic-packaging-international-adds-innovative-paperboard-punnet-to-sustainable-producepack-portfolio-301270801.html (Year: 2021).
AR Packaging: Announced [Mar. 4, 2021; online]. Retrieved [Nov. 2, 2023]. URL: https://news.cision.com/ar-packaging/i/ ar-packaging-fibre-tray-for-produce-dsc03115,c2884762 (Year: 2021).
Produce Packaging: Announced [Date not Available; online]. Retrieved [Nov. 2, 2023]. URL: https://bmxlovesk.xyz/product_details/ 12338874.html (Year: 2023).
Start Packaging: Announced [Date not Available; online]. Retrieved [Nov. 2, 2023]. URL: https://www.goodstartpackaging.com/2- quart-reversible-paper-produce-containers-sample/ (Year: 2023).
Supplementary European Search Report for EP 21 89 0060 dated Oct. 11, 2024.
U.S. Appl. No. 17/519,080, filed Nov. 4, 2021.
U.S. Appl. No. 29/785,893, filed May 27, 2021.
U.S. Appl. No. 17/519,084, filed Nov. 4, 2021.
U.S. Appl. No. 29/785,899, filed May 27, 2021.
U.S. Appl. No. 29/785,900, filed May 27, 2021.
U.S. Appl. No. 17/519,097, filed Nov. 4, 2021.
U.S. Appl. No. 29/785,905, filed May 27, 2021.
U.S. Appl. No. 17/519,107, filed Nov. 4, 2021.
U.S. Appl. No. 29/785,902, filed May 27, 2021.
U.S. Appl. No. 29/785,897, filed May 27, 2021.
U.S. Appl. No. 29/785,904, filed May 27, 2021.
U.S. Appl. No. 29/785,895, filed May 27, 2021.
U.S. Appl. No. 29/785,896, filed May 27, 2021.

* cited by examiner

TRAY FOR FOOD PRODUCTS

CROSS-REFERENCE TO RELATED APPLICATIONS

The present application claims the benefit of each of U.S. Provisional Patent Application No. 63/110,578, filed on Nov. 6, 2020, U.S. Provisional Patent Application No. 63/110,582, filed on Nov. 6, 2020, U.S. Provisional Patent Application No. 63/110,587, filed on Nov. 6, 2020, U.S. Provisional Patent Application No. 63/126,157, filed on Dec. 16, 2020, U.S. Provisional Patent Application No. 63/128,418, filed on Dec. 21, 2020, U.S. Provisional Patent Application No. 63/139,341, filed on Jan. 20, 2021, U.S. Provisional Patent Application No. 63/169,302, filed on Apr. 1, 2021, U.S. Provisional Patent Application No. 63/169,418, filed on Apr. 1, 2021, U.S. Provisional Patent Application No. 63/174,724, filed on Apr. 14, 2021, U.S. Provisional Patent Application No. 63/178,116, filed on Apr. 22, 2021, and U.S. Provisional Patent Application No. 63/191,412, filed on May 21, 2021.

INCORPORATION BY REFERENCE

The disclosures of each of U.S. Provisional Patent Application No. 63/110,578, filed on Nov. 6, 2020, U.S. Provisional Patent Application No. 63/110,582, filed on Nov. 6, 2020, U.S. Provisional Patent Application No. 63/110,587, filed on Nov. 6, 2020, U.S. Provisional Patent Application No. 63/126,157, filed on Dec. 16, 2020, U.S. Provisional Patent Application No. 63/128,418, filed on Dec. 21, 2020, U.S. Provisional Patent Application No. 63/139,341, filed on Jan. 20, 2021, U.S. Provisional Patent Application No. 63/169,302, filed on Apr. 1, 2021, U.S. Provisional Patent Application No. 63/169,418, filed on Apr. 1, 2021, U.S. Provisional Patent Application No. 63/174,724, filed on Apr. 14, 2021, U.S. Provisional Patent Application No. 63/178,116, filed on Apr. 22, 2021, and U.S. Provisional Patent Application No. 63/191,412, filed on May 21, 2021, are hereby incorporated by reference for all purposes as if presented herein in their entirety.

BACKGROUND OF THE DISCLOSURE

The present disclosure generally relates to trays for holding at least one food product.

SUMMARY OF THE DISCLOSURE

According to one aspect, the disclosure is generally directed to a tray for holding at least one food product, the tray comprising a plurality of panels extending at least partially around an interior of the tray, the plurality of panels comprising a bottom panel, a front panel, a back panel, and at least one side panel, a plurality of end flaps foldably connected to a respective panel of the plurality of panels and cooperating to form a rim extending outwardly from the plurality of panels, and reinforcement features for supporting the rim, the reinforcement features comprising at least one reinforcement tab extending from a respective panel of the plurality of panels and contacting a portion of a respective end flap of the plurality of end flaps.

According to another aspect, the disclosure is generally directed to a blank for forming a tray for holding at least one food product, the blank comprising a plurality of panels comprising a bottom panel, a front panel, a back panel, and at least one side panel a plurality of end flaps foldably connected to a respective panel of the plurality of panels and cooperating to form a rim extending outwardly from the plurality of panels when the tray is formed from the blank, and reinforcement features comprising at least one reinforcement tab extending from a respective panel of the plurality of panels, the at least one reinforcement tab for being positioned to contact a portion of a respective end flap of the plurality of end flaps to reinforce the rim when the tray is formed from the blank.

According to another aspect, the disclosure is generally directed to a method of forming a tray for holding at least one food product, the method comprising obtaining a blank comprising a plurality of panels comprising a bottom panel, a front panel, a back panel, and at least one side panel, the blank further comprising a plurality of end flaps foldably connected to a respective panel of the plurality of panels, and reinforcement features comprising at least one reinforcement tab extending from a respective panel of the plurality of panels. The method further comprises folding the plurality of panels at least partially around an interior of the tray, folding the plurality of end flaps to form a rim extending outwardly from the plurality of panels, and positioning the at least one reinforcement tab to contact a portion of a respective end flap of the plurality of end flaps to reinforce the rim.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Trays according to the present disclosure can accommodate articles of numerous different shapes. For the purpose of illustration and not for the purpose of limiting the scope of the disclosure, the following detailed description describes articles such as food products, e.g., fruit or vegetable items. In one embodiment, articles described herein can be fruits such as tomatoes (e.g., cherry tomatoes, etc.), berries (e.g., blueberries, raspberries, blackberries, strawberries, etc.), apples, oranges, tangerines, clementines, lemons, limes, cherries, etc. In another embodiment, articles described herein can be product packages, containers, bottles, cans, etc., that are at least partially disposed within the tray embodiments. The articles can be used for packaging food and beverage products, for example. Packaged articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; composite materials; and the like, or any combination thereof.

The articles described herein can include different types of food or beverage products, containers thereof, and/or having different shapes, without departing from the disclosure. In this specification, the terms "lower," "bottom," "upper," and "top" indicate orientations determined in relation to fully erected and upright trays. As described herein, trays can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

Figure 1:
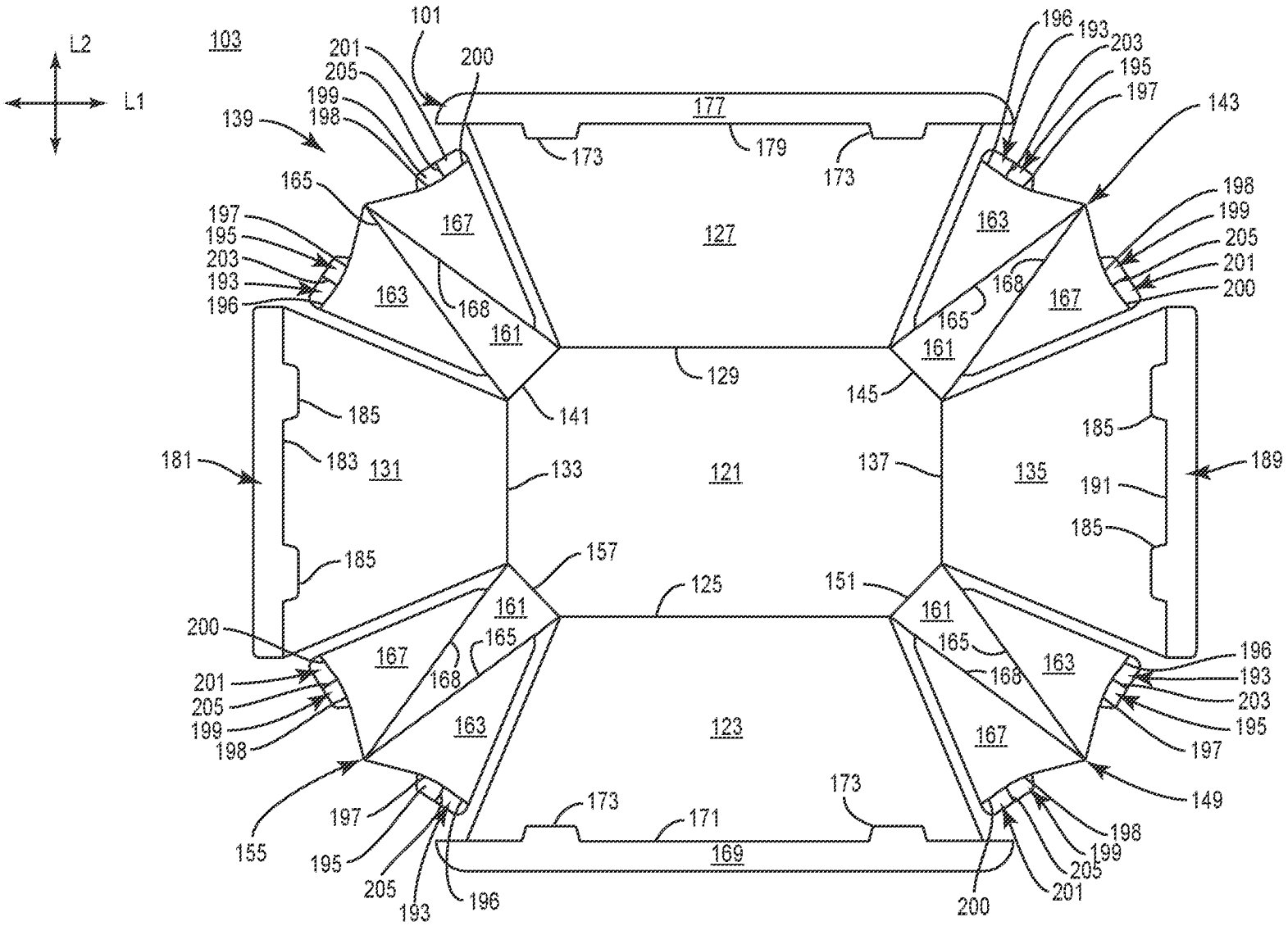
FIG. 1 is a plan view of an exterior surface of a blank used to form a tray according to a first exemplary embodiment of the disclosure.

FIG. 1 is a plan view of an exterior surface 101 of a blank, generally indicated at 103, used to form a tray 105 (FIG. 2) according to a first exemplary embodiment of the disclosure. In embodiments, the trays 105 described herein can have a generally elongate configuration with an open top portion, though the trays 105 can have a different configuration without departing from the disclosure.

As described further herein, the blank 103 includes engagement features for forming engagement features of the tray 105 that provide one or more surfaces for engaging a machine element or other component of a system associated with the formation, loading, and/or packaging of the tray 105. In addition, the engagement features of the blank 103/tray 105 provide one or more surfaces for receiving a lidding film, e.g., a polymeric film or other cover overlying the tray 105 to maintain one or more conditions of food products held therein. The engagement features of the tray 105 can also be arranged so as to maintain a structural integrity, e.g., rigidity/resistance to deformation, of the tray 105. Furthermore, the blank 103/tray 105 can be provided with reinforcement features that support/maintain/reinforce the engagement features of the tray 104. In some embodiments, features of the blank 103/tray 105 that contribute to the structural integrity of the tray 105 can be considered both engagement features and reinforcement features.

As shown, the blank 103 has a longitudinal axis L1 and a lateral axis L2 and includes a plurality of panels for extending at least partially around an interior 107 of the tray 105 when the tray 105 is formed from the blank 103. The panels can include a bottom panel 121, a front panel 123 foldably connected to the bottom panel 121 at a longitudinal fold line 125, a back panel 127 foldably connected to the bottom panel 121 at a longitudinal fold line 129, a first side panel 131 foldably connected to the bottom panel 121 at a lateral fold line 133, and a second side panel 135 foldably connected to the bottom panel 121 at a lateral fold line 137.

The blank 103 can also include a plurality of end flaps/corner panels/corner flaps foldably connected to respective panels of the plurality of panels of the blank 103. In the illustrated embodiment, the corner panels can include, in clockwise relation, a first corner panel 139 foldably connected to the bottom panel 121 at an oblique fold line 141, a second corner panel 143 foldably connected the bottom panel 121 at an oblique fold line 145, a third corner panel 149 foldably connected to the bottom panel 121 at an oblique fold line 151, and a fourth corner panel 155 foldably connected to the bottom panel 121 at an oblique fold line 157.

Each corner panel, as shown, includes a central section 161 foldably connected to the bottom panel 121 at a respective oblique fold line 141, 145, 151, 157, a first attachment section 163 foldably connected to the central section 161 at an oblique fold line 165, and a second attachment section 167 foldably connected to the central section 161 at an oblique fold line 168.

The blank 103/tray 105 can also include a plurality of end flaps foldably connected to respective panels of the plurality of panels. A front top end flap 169 can be foldably connected to the front panel 123 at a longitudinal fold line 171 at least partially interrupted by a longitudinally spaced pair of generally U-shaped cuts 173. Similarly, a back top end flap 177 can be foldably connected to the back panel 127 at a longitudinal fold line 179 interrupted by a longitudinally spaced pair of the cuts 173.

A first side top end flap 181 can be foldably connected to the first side panel 131 at a lateral fold line 183 interrupted by a laterally spaced pair generally U-shaped cuts 185. Similarly, a second side top end flap 189 can be foldably connected to the second side panel 135 at a lateral fold line 191 at least partially interrupted by a laterally spaced pair of the cuts 185.

As also shown, first corner section reinforcement tabs 193, 195 (broadly, "first reinforcement tab") can be foldably connected to the respective first attachment sections 163 of the respective corner panels 139, 143, 149, 155 at respective oblique fold lines 196, 197, and second corner section reinforcement tabs 199, 201 (broadly, "second reinforcement tab") can be foldably connected to the respective second attachment sections 167 of the respective corner panels 139, 143, 149, 155 at respective oblique fold lines 198, 200. As also shown, the first corner section reinforcement tabs 193, 195 can be foldably connected to one another at respective oblique fold lines 203, and the second corner section reinforcement tabs 199, 201 can be foldably connected to one another at respective oblique fold lines 205.

As described further herein, the corner engagement tabs 193, 195, 199, 201 are for at least partially engaging tabs formed by the cuts 173, 185 when the tray 105 is formed.

In one embodiment, the blank 103 can also include product visibility features for forming product visibility features of the tray 105, for example, one or more cuts, openings, etc., that can provide a customer with line-of-sight passages into the interior 107 of the tray 105, for example, to inspect food products held therein.

Figure 2:
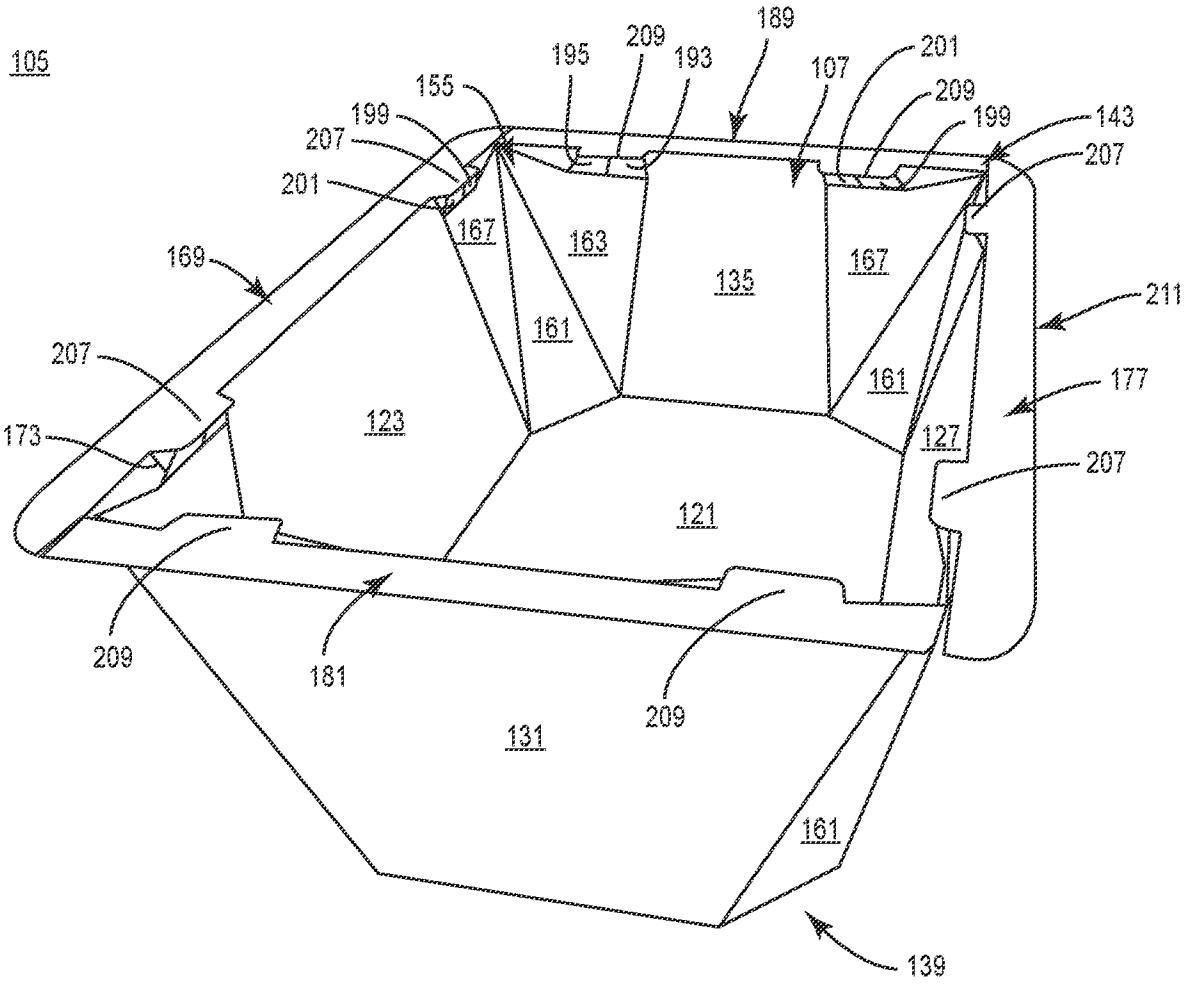
FIG. 2 is a perspective view of a tray formed from the blank of FIG. 1 according to the first exemplary embodiment of the disclosure.

Referring to FIG. 2, according to one embodiment of the disclosure, formation of the tray 105 from the blank 103 can be performed by inverting the blank 103 such that the exterior surface 101 is positioned on a supporting surface and such that the interior surface of the blank 103 is positioned facing upwardly.

The front panel 123, the back panel 127, the first side panel 131, and the second side panel 135 can be folded upwardly relative to the bottom panel 121 at the respective fold lines 125, 129, 133, 137. Simultaneously or thereafter, the first attachment section 163 of the corner panel 139 can be positioned into at least partial face-to-face contact with the interior surface of the first side panel 131 and the second attachment section 167 of the corner panel 139 can positioned into at least partial face-to-face contact with the interior surface of the back panel 127.

The corner panels 143, 149, and 155 can be folded in a similar manner as described above with regard to the corner panel 139, with the respective first attachment section 163 positioned into at least partial face-to-face contact with the back panel 127 and the respective second attachment section 167 positioned into at least partial face-to-face contact with the second side panel 135, the respective first attachment section 163 positioned into at least partial face-to-face contact with the second side panel 135 and the respective second attachment section 167 positioned into at least partial face-to-face contact with the front panel 123, and the respective first attachment section 163 positioned into at least partial face-to-face contact with the back panel 127 and the respective second attachment section 167 positioned into at least partial face-to-face contact with the first side panel 131.

Simultaneously or thereafter, the front top end flap 169 can be folded downwardly at the fold line 171 to extend outwardly from the front panel 123, e.g., in a generally horizontal orientation parallel to the bottom panel 121.

Similarly, the back top end flap 177 can be folded downwardly at the fold line 179 to extend outwardly from the back panel 127, the first side top end flap 181 can be folded downwardly at the fold line 183 to extend outwardly from the first side panel 131, and the second side top end flap 189 can be folded downwardly at the fold line 191 to extend outwardly from the second side panel 135, with respective top end flaps 193, 197 overlapped thereon to also fold downwardly at the respective fold lines 195, 198.

As shown, the folding of the top end flaps 169, 177, 181, 189 can cause respective engagement tabs 207 to separate at the cuts 179 and extend toward the interior 107 of the tray 105, and cause respective end flap engagement tabs 209 to separate at the cuts 185 and extend toward the interior 107 of the tray 105, e.g., in generally planar alignment with respect to the top end flaps 169, 177, 181, 189.

As described above, the end flap engagement tabs 207 extending from the top end flaps 169, 177 and the end flap engagement tabs 209 extending from the top end flaps 181, 189 are positioned to contact/engage the respective corner section reinforcement tabs 193, 197, 199, 201 of the respective corner panels 139, 143, 149, 155. In the illustrated embodiment, the corner section reinforcement tabs 193, 197 of the corner panel 139 can engage an adjacent end flap engagement tab 209 extending from the top end flap 181, the corner section reinforcement tabs 199, 201 of the corner panel 139 can engage an adjacent end flap engagement tab 207 extending from the top end flap 177, the corner section reinforcement tabs 193, 197 of the corner panel 143 can engage an adjacent end flap engagement tab 207 extending from the top end flap 177, the corner section reinforcement tabs 199, 201 of the corner panel 143 can engage an adjacent end flap engagement tab 209 extending from the top end flap 189, the corner section reinforcement tabs 193, 197 of the corner panel 149 can engage an adjacent end flap engagement tab 209 extending from the top end flap 189, the corner section reinforcement tabs 199, 201 of the corner panel 149 can engage an adjacent end flap engagement tab 207 extending from the top end flap 169, the corner section reinforcement tabs 193, 197 of the corner panel 155 can engage an adjacent end flap engagement tab 207 extending from the top end flap 169, and the corner section reinforcement tabs 199, 201 of the corner panel 155 can engage an adjacent end flap engagement tab 209 extending from the top end flap 181. Engagement/contact of the engagement tabs described herein can include one or more of at least partial edge-to-face contact, edge-to-edge contact, and face-to-face contact of respective engagement tabs.

In the illustrated embodiment of the tray 105, the panels 123, 127, 131, 135 can extend generally upwardly and obliquely outwardly from the bottom panel 121 such that the tray 105 has a generally tapered configuration, e.g., such that a top opening defined by the upper edges of the panels 123, 127, 131, 135 is larger than the bottom panel 121.

It will be understood that one or more food products P, as shown, can be dropped, placed, or otherwise positioned in the interior 107 of the tray 105 during or subsequent to the aforementioned steps. In one embodiment, the food products can be tomatoes, though one or more of the food products can be a different food product without departing from the disclosure.

Still referring to FIGS. 1 and 2, the foregoing arrangement of the tray 105 provides engagement tabs positioned for frictional engagement with one another to maintain/reinforce/support a rim 211 formed by the overlapped/cooperating arrangement of the top end flaps 169, 177, 181, 189, 193, 197 extending outwardly from the respective panels. The rim 211 extends outwardly from the panels 121, 123, 127, 131, 135 of the tray 105 and provides one or more engagement surfaces for being engaged/supported by an element associated with a forming apparatus for the tray 105, for example a machine element such as a grasper, fork, pincer, rail, etc. In one embodiment, the exterior (e.g., downward facing) surface of the top end flaps can present engagement surfaces for being engaged/supported by such a machine component. In other embodiments, engagement surfaces can include any combination of one or more of the exterior, interior (e.g., upward facing), and/or side-facing surfaces of one or more of the top end flaps 169, 177, 181, 189, 193, 197.

Figure 3:
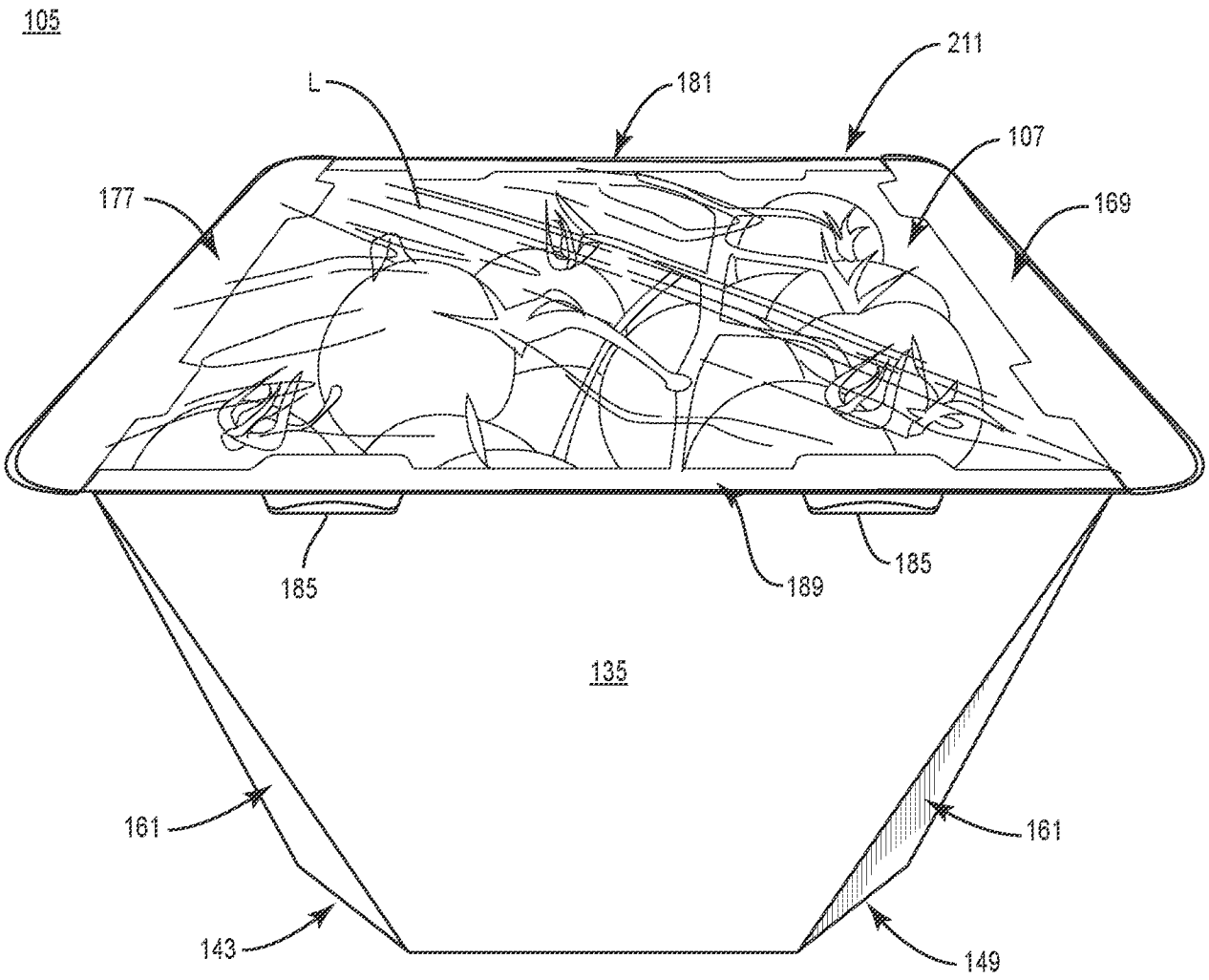
FIG. 3 is a perspective view of the tray of FIG. 2, additionally holding food products and covered with a lidding film.

With additional reference to FIG. 3, the positioning of the top end flaps 169, 177, 181, 189, 193, 197 extending away from the panels of the tray 105, also presents a plurality of engagement/support surfaces for engaging/supporting a lidding film F, e.g., a plastic or other polymeric film, or other covering structure. In one embodiment, the lidding film F can be provided as a polymeric layer that at least partially deforms in the presence of a heat source, e.g., a heat sealable film. The lidding film F can thus be positioned extending across a top opening of the tray 105 in contact with one or more surfaces tray one or more of the top end flaps 169, 177, 181, 189, 193, 197 to cover the interior 107 of the tray 105 and maintain one or more conditions of the food products held therein, e.g., freshness, ripeness, moisture content, etc. It will be understood that the lidding film can minimize, inhibit, and/or prevent the passage of one or more materials into the interior 107 of the tray 105, for example, condensation or other moisture, insects or other pests, dirt, debris, etc. In one embodiment, the tray 105 can be provided together with the lidding film and one or more food products as a package.

Furthermore, the contacting arrangement of the engagement tabs 193, 195, 199, 201, 207, 209 provides binding and/or reinforcement of a structural integrity/rigidity of the arrangement of the top end flaps 169, 177, 181, 189, 193, 197, as well as the tray 105 as a whole. For example, the enhanced rigidity provided to the arrangement of the top end flaps 169, 177, 181, 189, 193, 197 via engagement of engagement tabs 193, 195, 199, 201, 207, 298 can minimize, inhibit, and/or prevent bending, bowing, flexing, buckling, curling, other deformation, etc. of the rim 211. In this regard, forces exerted on the rim 211 via tension applied by a lidding film F disposed thereon can minimize, inhibit, and/or prevent deformation of the rim 211, e.g., to avoid undesirable product aesthetics, to avoid at least partial disengagement of the lidding film with the rim 211, to maintain a generally planar configuration of the rim 211 for stacking, storage, transport, etc. Accordingly, one or more of the engagement tabs 193, 195, 199, 201, 207, 209 can be considered reinforcement features of the tray 105.

It will be understood that one or more of the panels, flaps, and associated features of the blank 103/tray 105 can have a different arrangement or configuration without departing from the disclosure.

Figure 4:
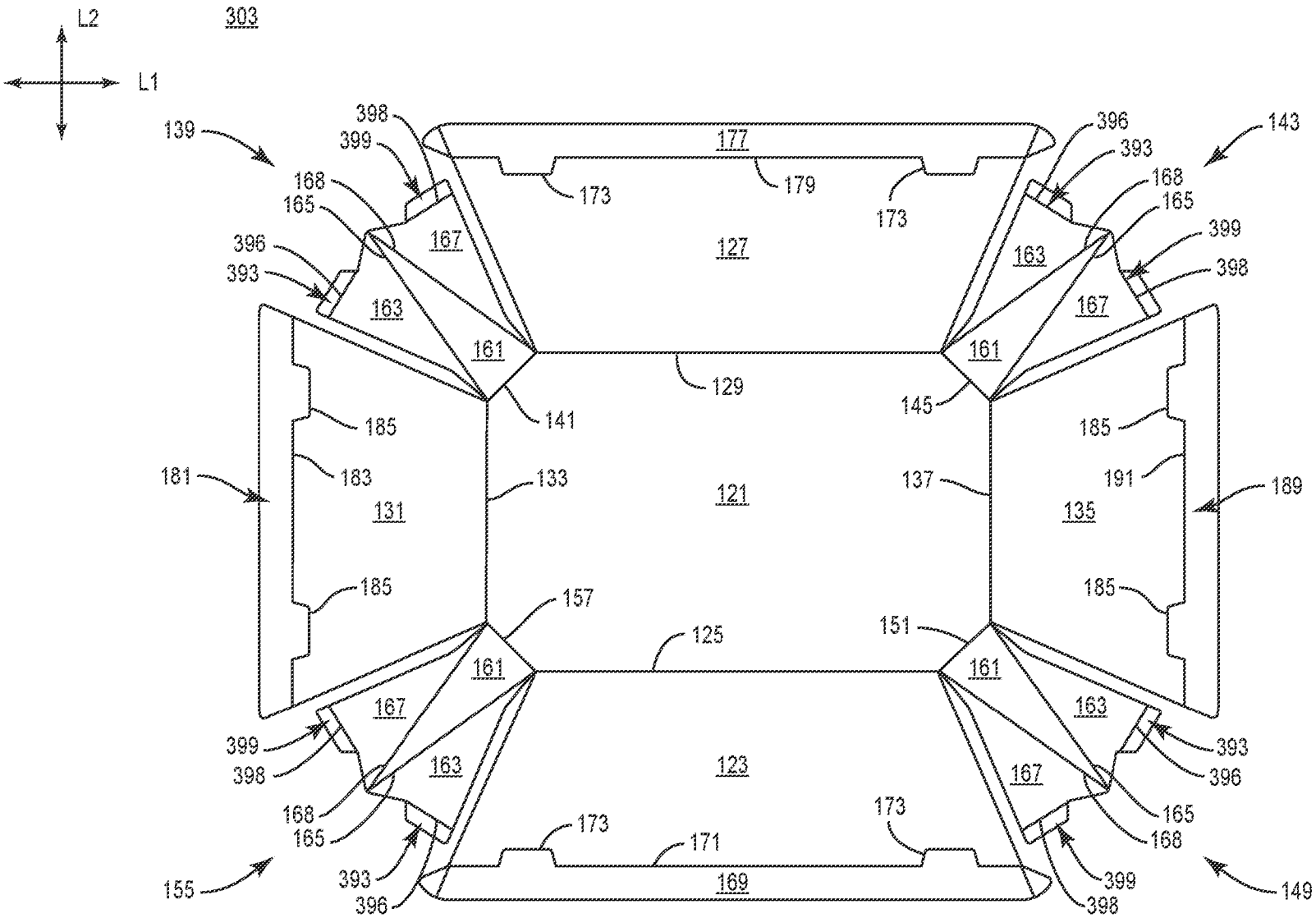
FIG. 4 is a plan view of an exterior surface of a blank used to form a tray according to a second exemplary embodiment of the disclosure.

Turning to FIG. 4, an exterior surface 301 of a blank 303 for forming a tray 305 (FIG. 5) according to a second exemplary embodiment of this disclosure is illustrated. The blank 303 and tray 305 can have one or more features similar to those of the blank 103/103A and tray 105 described above, and like or similar features are designated with like or similar reference numerals.

As shown, the blank 303 can have the longitudinal axis L1 and the longitudinal axis L2 and include the bottom panel 121, the front panel 123, the back panel 127, the side panels 131, 135, the corner panels 139, 143, 149, 155, the top end flaps 169, 177, 181, 189, 193, 197, and associated features (e.g., cuts, fold lines, tabs, etc.).

In this regard, the blank 303/tray 305 can have features that are generally similar to the blank 103/tray 105 described above, with the exception that a single first corner section reinforcement tab 393 (broadly, "first reinforcement tab" is foldably connected to the respective first attachment sections 163 of the respective corner panels 139, 143, 149, 155 at respective oblique fold lines 396, and a second corner section reinforcement tab 399 (broadly, "second reinforcement tab") is be foldably connected to the respective second attachment sections 167 of the respective corner panels 139, 143, 149, 155 at respective oblique fold lines 398.

Figure 5:
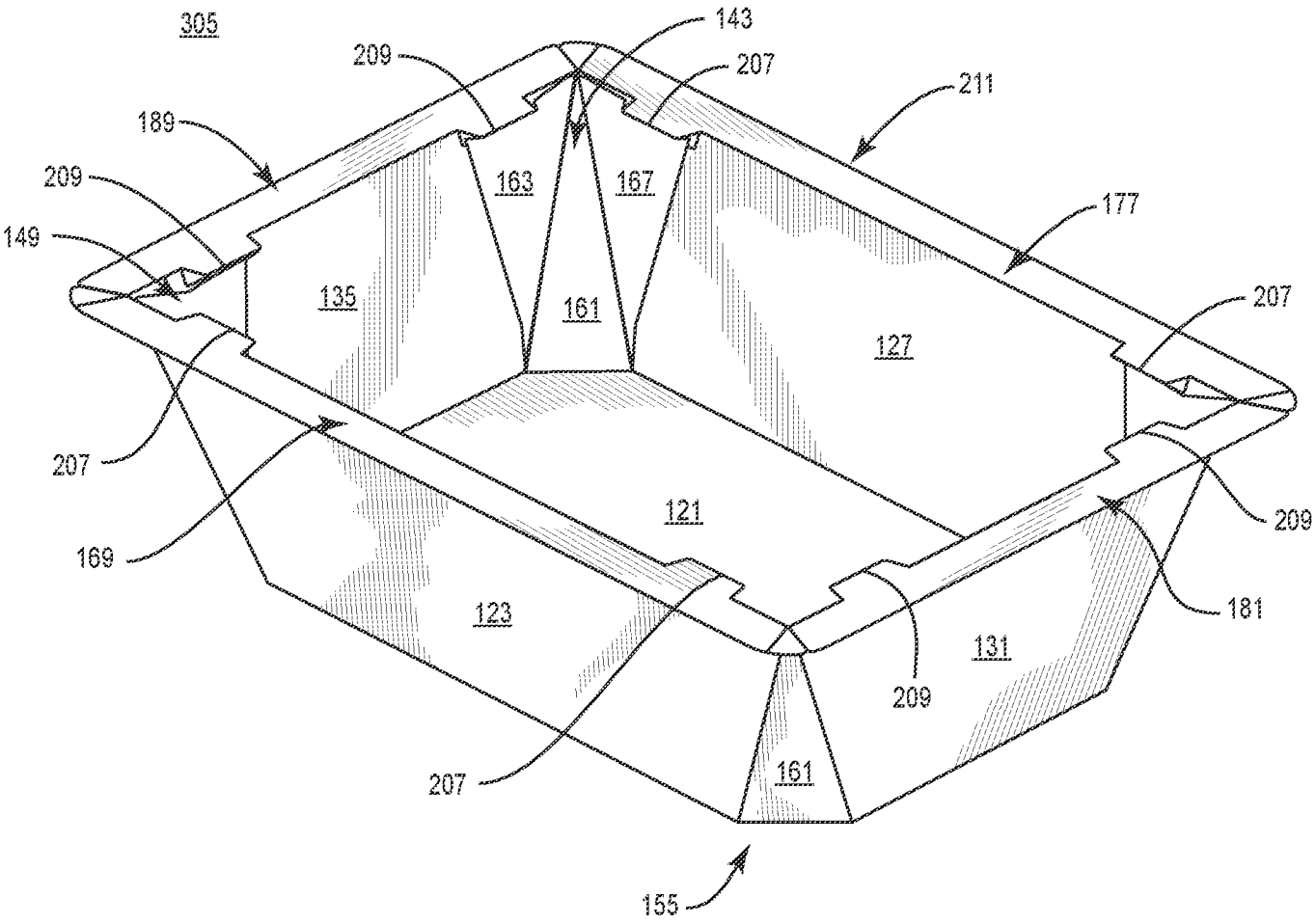
FIG. 5 is a perspective view of a tray formed from the blank of FIG. 4 according to the second exemplary embodiment of the disclosure.

With additional reference to FIG. 5, the tray 305 can be formed from the blank 303 in a manner similar to that described above with regard to the formation of the tray 105 from the blank 103. In the assembled configuration of the tray 305, the contacting arrangement of the engagement tabs 393, 399 with the respective end flap engagement tabs 207, 209 provides binding and/or reinforcement of a structural integrity/rigidity of the arrangement of the top end flaps 169, 177, 181, 189, 193, 197, as well as the tray 305 as a whole in a manner similar to that described above with regard to the tray 105, with similar advantages.

Figure 6:
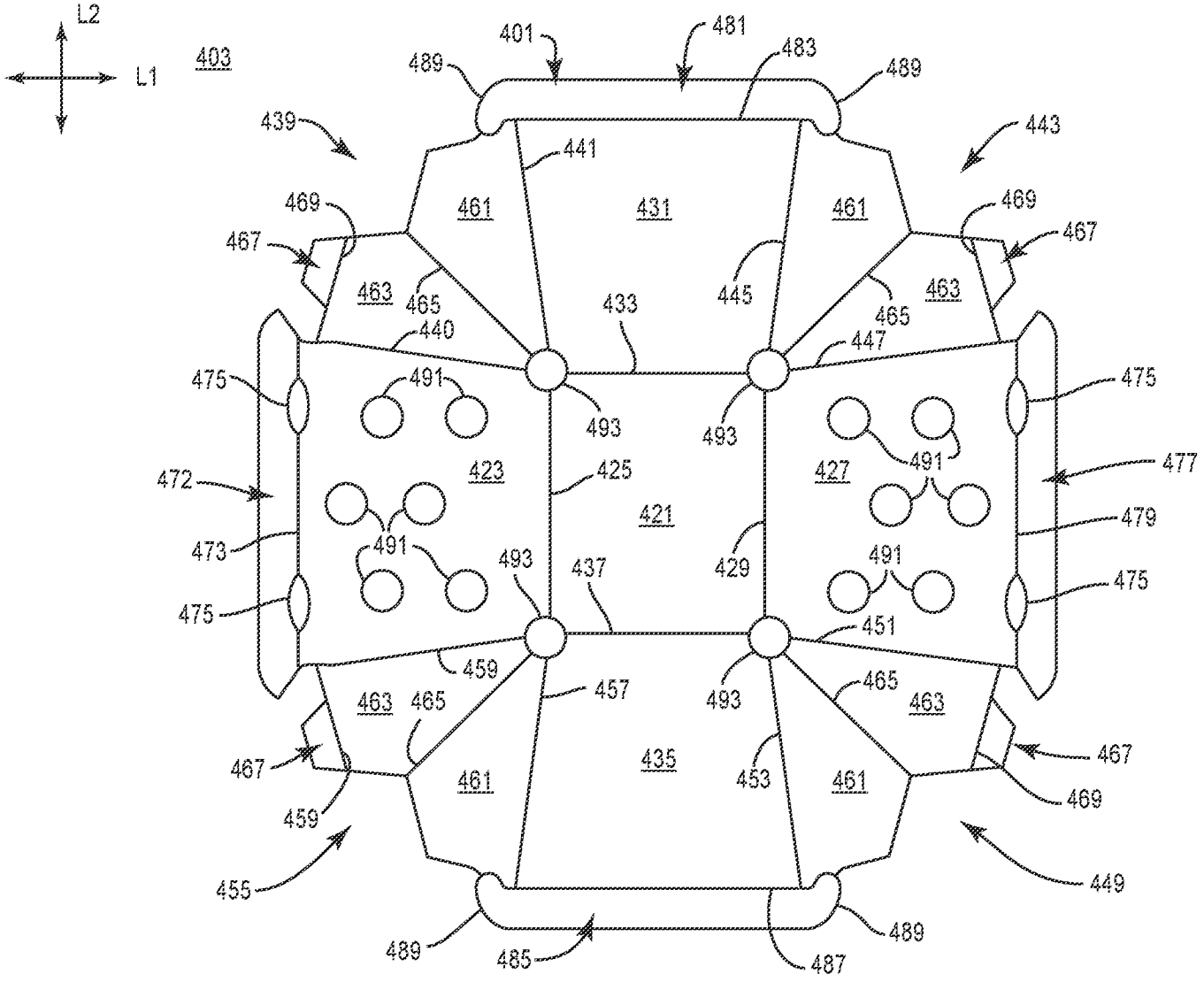
FIG. 6 is a plan view of an exterior surface of a blank used to form a tray according to a third exemplary embodiment of the disclosure.

Turning to FIG. 6, a plan view of an exterior surface 401 of a blank 403, used to form a tray 405 (FIG. 7) according to a third exemplary embodiment of the disclosure is illustrated.

As shown, the blank 403 has the longitudinal axis L1 and a lateral axis L2 and includes a plurality of panels for extending at least partially around an interior 407 of the tray 405 when the tray 405 is formed from the blank 403. The panels can include a bottom panel 421, a front panel 423 foldably connected to the bottom panel 421 at a lateral fold line 425, a back panel 427 foldably connected to the bottom panel 421 at a lateral fold line 429, a first side panel 431 foldably connected to the bottom panel 421 at a longitudinal fold line 433, and a second side panel 435 foldably connected to the bottom panel 421 at a longitudinal fold line 437.

The plurality of panels of the blank 403 can also include gussets foldably connected to respective panels of the plurality of panels of the blank 403. In the illustrated embodiment, the gussets can include, in clockwise relation, a first gusset 439 foldably connected to each of the front panel 423 and the first side panel 431 and at respective oblique fold lines 440, 441, a second gusset 443 foldably connected to each of the first side panel 431 and the back panel 427 at respective oblique fold lines 445, 447, a third gusset 449 foldably connected to each of the back panel 427 and the second side panel 435 at respective oblique fold lines 451, 453, and a fourth gusset 455 foldably connected to each of the second side panel 435 and the front panel 423 at respective oblique fold lines 457, 459.

Each gusset, as shown, includes a respective inner gusset panel 461 (broadly, "second gusset panel") positioned adjacent a respective side panel and foldably connected to a respective outer gusset panel 463 (broadly, "first gusset panel") at a respective oblique fold line 465 such that each outer gusset panel 463 is positioned adjacent a respective one of the front panel 423 and the back panel 427. As also shown, a reinforcement tab 467 is foldably connected to each outer gusset panel 463 at a respective oblique fold line 469. As described further herein, the reinforcement tabs 467 can form the reinforcement features of the tray 405. The gussets can have a different shape, arrangement, and/or configuration without departing from the disclosure. In one embodiment, one or more of the reinforcement tabs 467 can be considered an end flap of the blank 403/tray 405.

The blank 403/tray 405 can also include a plurality of end flaps foldably connected to respective panels of the plurality of panels. A front top end flap 472 can be foldably connected to the front panel 423 at a lateral fold line 473 at least partially interrupted by a pair of laterally spaced cuts/openings 475 each having one or more of curved, angled, and/or straight portions. In the illustrated embodiment, the cuts/openings 475 can have a generally ovoid configuration, though one or more of the cuts 475 can have a different configuration without departing from the disclosure. Similarly, a back top end flap 477 can be foldably connected to the back panel 427 at a lateral fold line 479 interrupted by a longitudinally spaced pair of the cuts/openings 475. In one embodiment, the cuts 475 can define locking openings (broadly, "female locking features", "first locking opening", "second locking opening") in the tray 405 for at least partially receiving respective male locking features, as described further herein.

A first side top end flap 481 can be foldably connected to the first side panel 431 at a longitudinal fold line 483, and, similarly, a second side top end flap 485 can be foldably connected to the second side panel 435 at a longitudinal fold line 487. The side top end flaps 481, 485, as shown, can each include respective locking portions 489 (broadly, "male locking features", "first locking portion", "second locking portion") at respective longitudinal end portions thereof and extending generally perpendicularly away from respective central portions of the side top end flaps 481, 485. The locking portions 489, as shown, can include one or more protruding features, e.g., having curved, angled, and/or straight portions, extending laterally away from the respective side top end flaps 481, 485.

The blank 403 can also include product visibility features for forming product visibility features of the tray 405. In the illustrated embodiment, each of the front panel 423 and the back panel 427 can include one or more openings 491. In addition, generally curved or circular cuts 493 can be formed at least partially along corners of the bottom panel 421, and extend into respective portions of the front panel 423, the back panel 427, the side panels 431, 435, and the respective gusset panels 461, 463. As described further herein, the product visibility features can provide a customer with line-of-sight passages into the interior 407 of the tray 405, for example, to inspect food products held therein. In addition, one or more of the product visibility features can provide a path of egress for moisture, e.g., condensation, runoff, etc. to exit the interior 407 of the tray 405.

Figure 7:
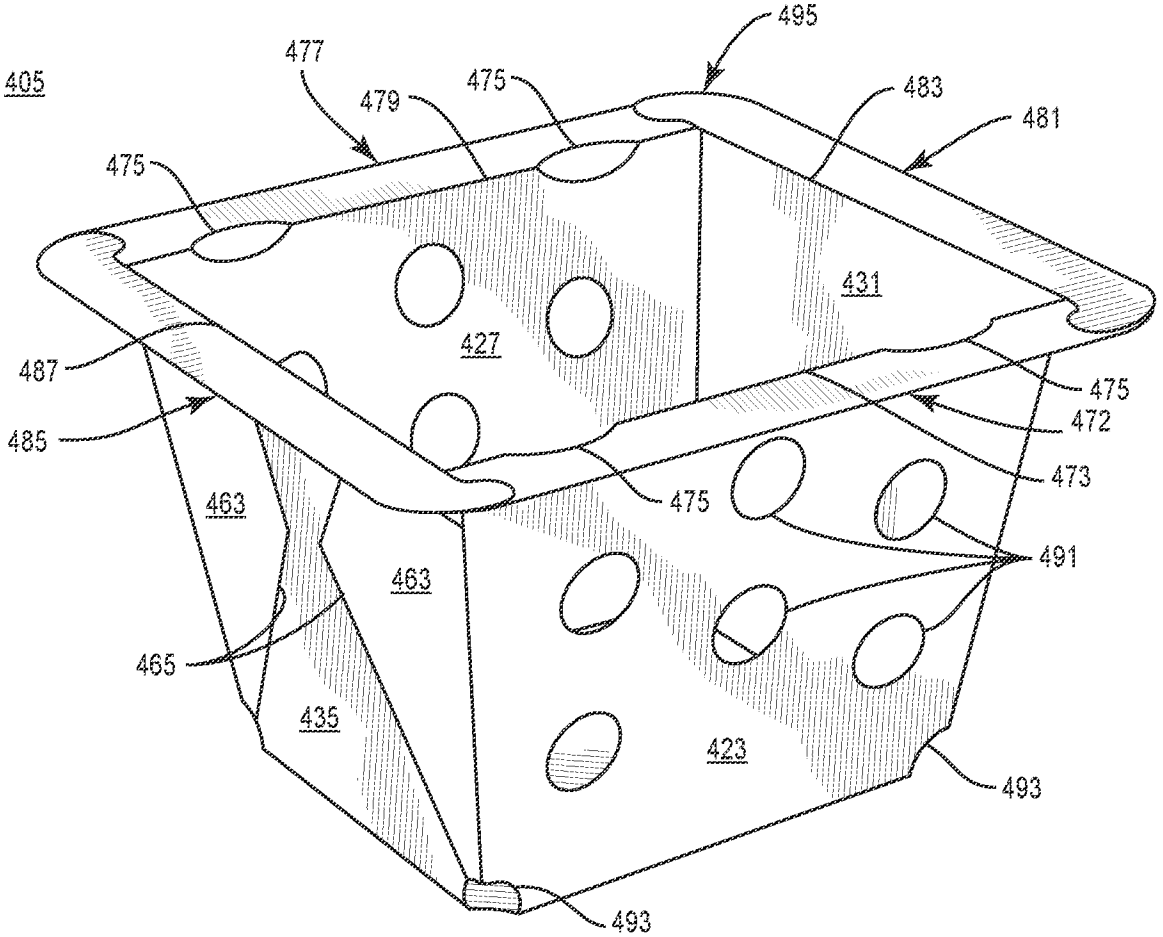
FIG. 7 is a perspective view of a tray formed from the blank of FIG. 6 according to the third exemplary embodiment of the disclosure.
Figure 8:
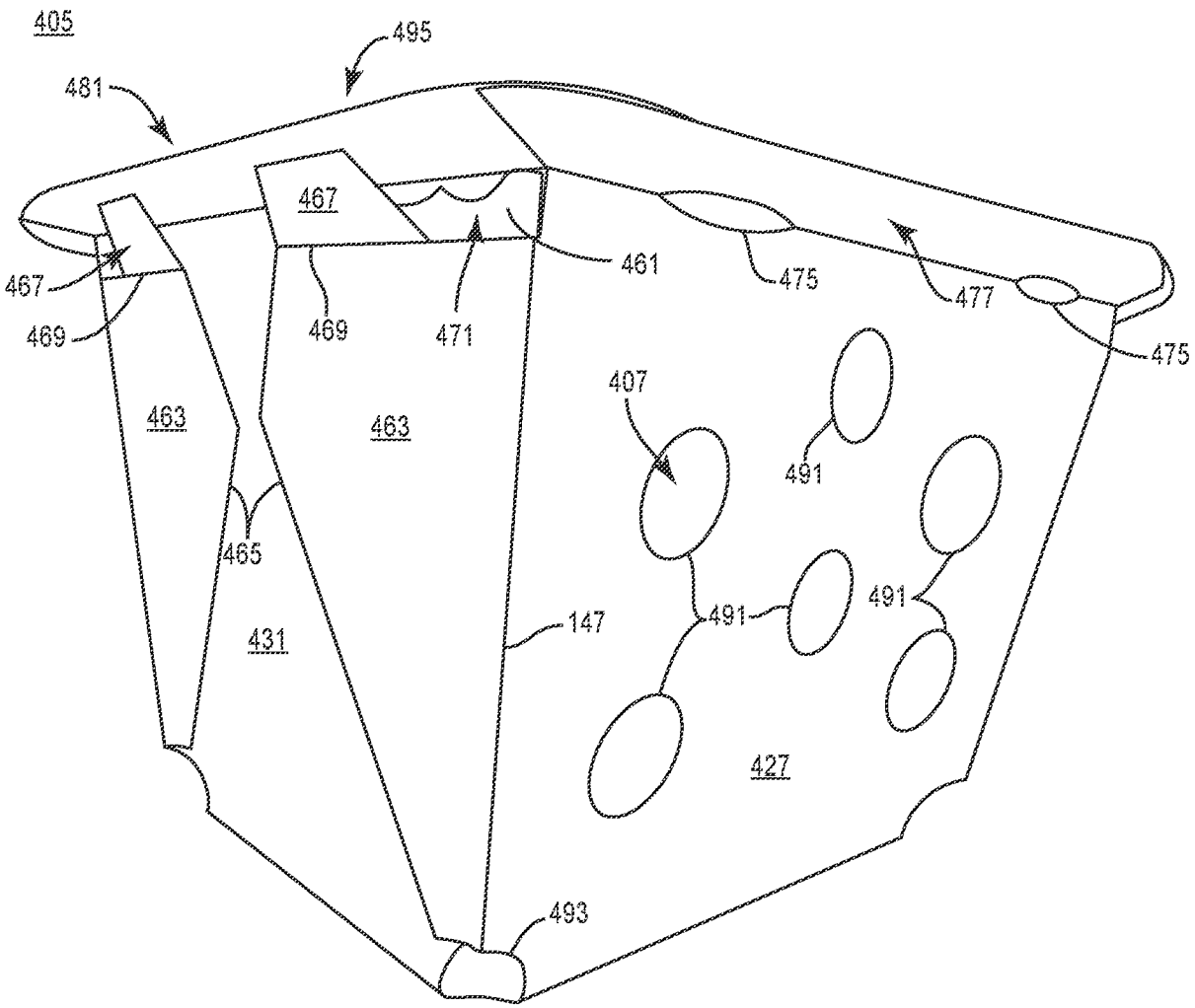
FIG. 8 is an enlarged view of a portion of the tray of FIG. 7.

Turning to FIGS. 7 and 8, according to one embodiment of the disclosure, formation of the tray 405 from the blank 403 can be performed by inverting the blank 403 such that the exterior surface 401 is positioned on a supporting surface and such that the interior surface of the blank 403 can be positioned facing upwardly.

The front panel 423, the back panel 427, the first side panel 431, and the second side panel 435 can be folded upwardly relative to the bottom panel 421 at the respective fold lines 425, 429, 433, 437.

The inner gusset panel 461 of the first gusset 439 can be folded at the fold line 441 into at least partial face-to-face contact with the side panel 431 and the outer gusset panel 463 of the first gusset 439 can be folded at the fold line 465 into at least partial face-to-face contact with the outer gusset panel 461. Such movement of the gusset panel 461 of the first gusset 439 can cause at least partial folding of the outer gusset panel 463 at the fold line 440 relative to the front panel 423 such that the front panel 423 and the first side panel 431 are drawn or approximated together.

Similarly, the inner gusset panel 461 of the second gusset 443 can be folded at the fold line 445 into at least partial face-to-face contact with the first side panel 431 and the outer gusset panel 463 of the second gusset 443 can be folded at the fold line 465 into at least partial face-to-face contact with the inner gusset panel 461, the inner gusset panel 461 of the third gusset 449 can be folded at the fold line 453 into at least partial face-to-face contact with the second side panel 435 and the outer gusset panel 463 of the second gusset 449 can be folded at the fold line 465 into at least partial face-to-face contact with the inner gusset panel 461, and the inner gusset panel 161 of the fourth gusset 455 can be folded at the fold line 457 into at least partial face-to-face contact with the second side panel 435 and the outer gusset panel 463 of the fourth gusset 455 can be folded at the fold line 465 into at least partial face-to-face contact with the inner gusset panel 461.

In the above-described arrangement, each respective outer gusset panel 463 is positioned overlapping each respective inner gusset panel 461 such that each respective reinforcement tab 467 is positioned in an upwardly-extending arrangement.

Simultaneously or thereafter, the front top end flap 472 can be folded downwardly at the fold line 473 to extend outwardly from the front panel 423, e.g., in a generally horizontal orientation parallel to the bottom panel 421.

Similarly, the back top end flap 477 can be folded downwardly at the fold line 479 to extend outwardly from the back panel 427, the first side top end flap 481 can be folded downwardly at the fold line 483 to extend outwardly from the first side panel 431, and the second side top end flap 485 can be folded downwardly at the fold line 487 to extend outwardly from the second side panel 435.

In such an arrangement the top end flaps 481, 485 can be positioned overlapping, e.g., in at least partial face-to-face contact with, respective portions of the top end flaps 472, 477 to cooperate and form an upper rim/flange 495 of the tray 405 that extends outwardly from the panels 421, 423, 427, 431, 435 of the tray 405. In one embodiment, the locking portions 489 of the respective top end flaps 481, 485 can thus be positioned to be at least partially inserted, for example, manually by an operator and/or by a machine component of an apparatus for forming the tray 405, through the respective cuts/openings 475 to reinforce the rim/flange 495 of the tray 405.

During the aforementioned downward folding of the top end flaps 481, 485 at the respective fold lines 483, 487, the respective reinforcement tabs 467 are positioned to at least partially contact the respective top end flaps 481, 485 to reinforce, e.g., brace, support, bolster, provide pressure points/backpressure, and/or otherwise maintain the configuration of the rim/flange 495 of the tray 405, for example, by minimizing, inhibiting, preventing, and/or otherwise resisting downward movement/deflection and/or deformation of the respective top end flaps 481, 485. In the course of such engagement, the reinforcement tabs 467 can/may fold at the respective fold line 469 toward a generally oblique arrangement relative to the respective top end flaps 481, 485.

In the illustrated embodiment of the tray 405, the panels 423, 427, 431, 435 can extend generally upwardly and obliquely outwardly from the bottom panel 421 such that the tray 405 has a generally tapered configuration, e.g., such that a top opening defined by the upper edges of the panels 423, 427, 431, 435 is larger than the bottom panel 421.

It will be understood that one or more food products can be dropped, placed, or otherwise positioned in the interior 407 of the tray 405 during or subsequent to the aforementioned steps. In one embodiment, the food products can be berries, though one or more of the food products can be a different food product without departing from the disclosure. The tray 405 can be provided with one or more food products as a package.

Still referring to FIGS. 4-7, engagement features of the tray 405 include the arrangement of the top end flaps 472, 477, 481, 485, together or in subcombinations. As shown, the folded arrangement of the top end flaps 472, 477, 481, 485 extending outwardly from the respective panels forms the rim 495 and one or more engagement surfaces for being engaged/supported by an element associated with a forming apparatus for the tray 405, for example a machine element such as a grasper, fork, pincer, rail, etc. In one embodiment, the exterior (e.g., downward facing) surface of the top end flaps can present engagement surfaces for being engaged/supported by such a machine component. In other embodiments, engagement surfaces can include any combination of one or more of the exterior, interior (e.g., upward facing), and/or side-facing surfaces of one or more of the top end flaps 472, 477, 481, 485.

The positioning of the top end flaps 472, 477, 481, 485 extending away from the panels of the tray 405, also presents a plurality of engagement/support surfaces for engaging/supporting a covering or lidding film, e.g., a plastic or other polymeric film such as the lidding film F (FIG. 3), or other covering structure. In one embodiment, the lidding film can be provided as a polymeric layer that at least partially deforms in the presence of a heat source, e.g., a heat sealable film. The lidding film can thus be positioned extending across a top opening of the tray 405 in contact with one or more surfaces of one or more of the top end flaps 472, 477, 481, 485 to cover the interior 407 of the tray 405 and maintain one or more conditions of the food products held therein, e.g., freshness, ripeness, moisture content, etc. It will be understood that the lidding film can minimize, inhibit, and/or prevent the passage of one or more materials into the interior 407 of the tray 405, for example, condensation or other moisture, insects or other pests, dirt, debris, etc. In one embodiment, the tray 405 can be provided together with the lidding film and one or more food products as a package.

Furthermore, the reinforcement features of the tray 405 include the reinforcement tabs 467, together or in subcombinations, which are foldably connected to respective panels of the plurality of panels and the positioning of which under and at least partially contacting the respective top end flaps 481, 485 can minimize, inhibit, prevent, and/or otherwise resist bending, bowing, flexing, buckling, curling, deflection, and/or other deformation of the rim/flange 495. In this regard, forces exerted on the rim/flange 495 via tension applied through a covering or lidding film disposed thereon can minimize, inhibit, and/or prevent deformation of the rim/flange 495, e.g., to avoid undesirable product aesthetics, to avoid at least partial disengagement of the lidding film with the rim/flange 495, to maintain a generally planar configuration of the rim/flange 495 for stacking, storage, transport, etc. In one embodiment, the tray 405 can be provided with one or more food products and a lidding film as a package.

In one embodiment, the engagement of one or more of the respective locking portions 489 of the top end flaps 481, 485 and the respective cuts/locking openings 475 can be considered part of the reinforcement features of the tray 405.

It will be understood that one or more of the panels, flaps, and associated features of the blank 403/tray 405 can have a different arrangement or configuration without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the trays, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure tray panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding at least one food product, the tray comprising:

a plurality of panels extending at least partially around an interior of the tray, the plurality of panels comprising a bottom panel, a front panel, a back panel, at least one side panel, and at least one corner panel;

a plurality of end flaps, cooperating to form a rim extending outwardly from the plurality of panels, wherein a first end flap of the plurality of end flaps is foldably connected to a side panel of the at least one side panel, the first end flap having an engagement tab; and reinforcement features for supporting the rim, the reinforcement features comprising at least one reinforcement tab foldably connected to the at least one corner panel, extending into the interior of the tray, and contacting the engagement tab of the first end flap, the at least one corner panel in at least partial face-to-face contact with the side panel of the at least one side panel to which the first end flap of the plurality of end flaps is foldably connected, the at least one corner panel comprises a central section and at least one attachment section foldably connected to the central section, the at least one reinforcement tab foldably connected to the at least one attachment section, the at least one attachment section is a first attachment section foldably connected to the central section, the at least one corner panel further comprises a second attachment section foldably connected to the central section, the at least one reinforcement tab is a first reinforcement tab foldably connected to the first attachment section, the reinforcement features further comprise a second reinforcement tab foldably connected to the second attachment section, the plurality of end flaps further comprises a back top end flap foldably connected to the back panel, and a front top end flap foldably connected to the front panel, the engagement tab is a first engagement tab extending from the at least one side panel toward the interior of the tray, the first reinforcement tab contacts the first engagement tab, and the reinforcement features further comprise a second engagement tab extending from one of the front panel or the back panel toward the interior of the tray, the second reinforcement tab contacts the second engagement tab.

2. The tray of claim 1, wherein an edge of the at least one reinforcement tab contacts the engagement tab.

3. A blank for forming a tray for holding at least one food product, the blank comprising:

a plurality of panels comprising a bottom panel, a front panel, a back panel, at least one side panel, and at least one corner panel, the plurality of panels being for extending at least partially around an interior of a tray when the tray is formed from the blank;

a plurality of end flaps cooperating to form a rim extending outwardly from the plurality of panels when the tray is formed from the blank, wherein a first end flap of the plurality of end flaps is foldably connected to a side panel of the at least one side panel, the first end flap including an engagement tab that extends into the interior of the tray when the tray is formed from the blank; and reinforcement features comprising at least one reinforcement tab foldably connected to the at least one corner panel, the at least one reinforcement tab extending into the interior of the tray and contacting the engagement tab of the first end flap to reinforce the rim when the tray is formed from the blank, at least one corner panel in at least partial face-to-face contact with the side panel of the at least one side panel to which the first end flap of the plurality of end flaps is foldably connected when the tray is formed from the blank, the at least one corner panel comprises a central section and at least one attachment section foldably connected to the central section, the at least one reinforcement tab foldably connected to the at least one attachment section, the at least one attachment section is a first attachment section foldably connected to the central section, the at least one corner panel further comprises a second attachment section foldably connected to the central section, the at least one reinforcement tab is a first reinforcement tab foldably connected to the first attachment section, the reinforcement features further comprise a second reinforcement tab foldably connected to the second attachment section, the plurality of end flaps further comprises a back top end flap foldably connected to the back panel, and a front top end flap foldably connected to the front panel, the engagement tab is a first engagement tab extending from the first end flap for being positioned to extend from the side panel toward the interior of the tray when the tray is formed from the blank, the first reinforcement tab is for being positioned to contact the first engagement tab when the tray is formed from the blank, and the reinforcement features further comprise a second engagement tab for being positioned to extend from one of the front panel or the back panel toward the interior of the tray when the tray is formed from the blank, the second reinforcement tab is for being positioned to contact the second engagement tab when the tray is formed from the blank.

4. A method of forming a tray for holding at least one food product, the method comprising:

obtaining a blank comprising a plurality of panels comprising a bottom panel, a front panel, a back panel, at least one side panel, and at least one corner panel, the blank further comprising a plurality of end flaps, and reinforcement features comprising at least one reinforcement tab foldably connected to the at least one corner panel, wherein a first end flap of the plurality of end flaps is foldably connected to a side panel of the at least one side panel, the first end flap having an engagement tab;

folding the plurality of panels at least partially around an interior of the tray;

folding the plurality of end flaps to form a rim extending outwardly from the plurality of panels;

positioning the at least one reinforcement tab to extend into the interior of the tray and contact the engagement tab to reinforce the rim; and positioning the at least one corner panel in at least partial face-to-face contact with the side panel of the at least one side panel to which the first end flap of the plurality of end flaps is foldably connected, the at least one corner panel comprises a central section and at least one attachment section foldably connected to the central section, the at least one reinforcement tab foldably connected to the at least one attachment section, the at least one attachment section is a first attachment section foldably connected to the central section, the at least one corner panel further comprises a second attachment section foldably connected to the central section, the at least one reinforcement tab is a first reinforcement tab foldably connected to the first attachment section, the reinforcement features further comprise a second reinforcement tab foldably connected to the second attachment section, the plurality of end flaps further comprises a back top end flap foldably connected to the back panel, and a front top end flap foldably connected to the front panel, the engagement tab is a first engagement tab extending from the at least one side panel toward the interior of the tray, the first reinforcement tab contacts the first engagement tab, and the reinforcement features further comprise a second engagement tab extending from one of the front panel or the back panel toward the interior of the tray, the second reinforcement tab contacts the second engagement tab.

5. The method of claim 4, wherein an edge of the at least one reinforcement tab contacts the engagement tab.

* * * * *